US006675498B1

(12) United States Patent
Ellis, III

(10) Patent No.: US 6,675,498 B1
(45) Date of Patent: Jan. 13, 2004

(54) SHOE SOLE STRUCTURES

(75) Inventor: Frampton E. Ellis, III, Arlington, VA (US)

(73) Assignee: Anatomic Research, Inc., Arlington, VA (US)

( * ) Notice: Subject to any disclaimer, the term of this patent is extended or adjusted under 35 U.S.C. 154(b) by 0 days.

(21) Appl. No.: 08/482,838

(22) Filed: Jun. 7, 1995

Related U.S. Application Data

(63) Continuation of application No. 08/452,490, filed on May 30, 1995, now Pat. No. 6,360,453, which is a continuation of application No. 08/142,120, filed on Oct. 28, 1993, now abandoned, which is a continuation of application No. 07/830,747, filed on Feb. 7, 1992, now abandoned, which is a continuation of application No. 07/416,478, filed on Oct. 3, 1989, now abandoned, and a continuation of application No. 08/162,962, filed on Dec. 8, 1993, now Pat. No. 5,544,429, which is a continuation of application No. 07/930,469, filed on Aug. 20, 1992, now Pat. No. 5,317,819, which is a continuation of application No. 07/239,667, filed on Sep. 2, 1988, now abandoned, and a continuation of application No. 07/492,360, filed on Mar. 9, 1990, now Pat. No. 4,989,349, which is a continuation of application No. 07/219,387, filed on Jul. 15, 1988, now abandoned.

(51) Int. Cl.[7] ..... A43B 13/14

(52) U.S. Cl. ..... 36/25 R; 36/30 R; 36/31; 36/88; 36/114

(58) Field of Search ..... 36/32 R, 25 R, 36/30 R, 31, 114, 88, 91, 28, 163, 116, 11.5, 11

(56) References Cited

U.S. PATENT DOCUMENTS

| | | | |
|---|---|---|---|
| 288,127 | A | 11/1883 | Shepard |
| 532,429 | A | 1/1895 | Rogers |
| 1,283,335 | A | 10/1918 | Shillcock |
| 1,289,106 | A | 12/1918 | Bullock |
| 1,458,446 | A | 6/1923 | Shaeffer |
| 1,622,860 | A | 3/1927 | Cutler |
| 1,639,381 | A | 8/1927 | Manelas |
| 1,701,260 | A | 2/1929 | Fischer |
| 1,735,986 | A | 11/1929 | Wray |
| 1,853,034 | A | 4/1932 | Bradley |
| 2,120,987 | A | 6/1938 | Murray |
| 2,147,197 | A | 2/1939 | Glidden |
| 2,155,166 | A | 4/1939 | Kraft |
| 2,170,652 | A | 8/1939 | Brennan |
| 2,179,942 | A | 11/1939 | Lyne |
| 2,328,242 | A | 8/1943 | Witherill |
| 2,433,329 | A | 12/1947 | Adler et al. |
| 2,434,770 | A | 1/1948 | Lutey |
| 2,627,676 | A | 2/1953 | Hack |
| 2,718,715 | A | 9/1955 | Spilman |
| 2,814,133 | A | 11/1957 | Herbst |

(List continued on next page.)

FOREIGN PATENT DOCUMENTS

| | | |
|---|---|---|
| AT | 200963 | 5/1958 |
| CA | 1 138 194 | 12/1982 |

(List continued on next page.)

OTHER PUBLICATIONS

Originally filed specification for U.S. patent application No. 08/648,792, filed Aug. 28, 2000.
Originally filed specification for U.S. patent application No. 08/462,531, filed Jun. 5, 1995.

(List continued on next page.)

*Primary Examiner*—Anthony D. Stashick
(74) *Attorney, Agent, or Firm*—Finnegan & Henderson et al.

(57) ABSTRACT

A shoe having a sole contour which follows a theoretically ideal stability plane as a basic concept, but which deviates outwardly therefrom to provide greater than natural stability. Thickness variations outwardly from the stability plane are disclosed, along with density variations to achieve a similar greater than natural stability.

20 Claims, 8 Drawing Sheets

U.S. PATENT DOCUMENTS 3,005,272 A 10/1961 Shelare et al.
3,100,354 A 8/1963 Lombard et al.
3,110,971 A 11/1963 Chang
3,305,947 A 2/1967 Kalsoy
3,308,560 A 3/1967 Jones
3,416,174 A 12/1968 Novitske
3,512,274 A 5/1970 McGrath
3,535,799 A 10/1970 Onitsuka
3,806,974 A 4/1974 Di Paolo
3,824,716 A 7/1974 Di Paolo
3,863,366 A 2/1975 Auberry et al.
3,958,291 A 5/1976 Spier
3,964,181 A * 6/1976 Holcombe, Jr. ..... 36/25 R X
3,997,984 A 12/1976 Hayward
4,003,145 A 1/1977 Liebscher et al.
4,030,213 A 6/1977 Daswick
4,068,395 A 1/1978 Senter
4,083,125 A 4/1978 Benseler et al.
4,096,649 A 6/1978 Saurwein
4,098,011 A 7/1978 Bowerman et al.
4,128,951 A 12/1978 Tansill
4,141,158 A 2/1979 Benseler et al.
4,145,785 A 3/1979 Lacey
4,149,324 A 4/1979 Lesser et al.
4,161,828 A 7/1979 Benseler et al.
4,161,829 A 7/1979 Wayser
4,170,078 A 10/1979 Moss
4,183,156 A 1/1980 Rudy
4,194,310 A 3/1980 Bowerman
4,217,705 A 8/1980 Donzis
4,219,945 A 9/1980 Rudy
4,223,457 A 9/1980 Borgeas
4,227,320 A 10/1980 Borgeas
4,235,026 A 11/1980 Plagenhoef
4,240,214 A 12/1980 Sigle et al.
4,241,523 A 12/1980 Daswick
4,245,406 A 1/1981 Landay et al.
4,250,638 A 2/1981 Linnemann
4,258,480 A 3/1981 Famolare, Jr.
4,259,792 A 4/1981 Halberstadt
4,262,433 A 4/1981 Hagg et al.
4,263,728 A 4/1981 Frecentese
4,266,349 A 5/1981 Schmohl
4,268,980 A 5/1981 Gudas
4,271,606 A 6/1981 Rudy
4,272,858 A 6/1981 Hlustik
4,274,211 A 6/1981 Funck
4,297,797 A 11/1981 Meyers
4,302,892 A 12/1981 Adamik
4,305,212 A 12/1981 Coomer
4,308,671 A 1/1982 Bretschneider
4,309,832 A 1/1982 Hunt
4,316,332 A 2/1982 Giese et al.
4,316,335 A 2/1982 Giese et al.
4,319,412 A 3/1982 Muller et al.
4,322,895 A 4/1982 Hockerson
4,335,529 A 6/1982 Badalamenti
4,340,626 A 7/1982 Rudy
4,342,161 A 8/1982 Schmohl
4,348,821 A 9/1982 Daswick
4,354,319 A 10/1982 Block et al.
4,361,971 A 12/1982 Bowerman
4,366,634 A 1/1983 Giese et al.
4,370,817 A 2/1983 Ratanangsu
4,372,059 A * 2/1983 Ambrose ..... 36/30 R X
4,398,357 A 8/1983 Batra
4,399,620 A 8/1983 Funck
4,449,306 A * 5/1984 Cavanagh ..... 36/30 R
4,451,994 A 6/1984 Fowler
4,454,662 A 6/1984 Stubblefield
4,455,765 A 6/1984 Sjöswärd
4,455,767 A 6/1984 Bergmans
4,468,870 A 9/1984 Sternberg
4,484,397 A 11/1984 Curley, Jr.
4,494,321 A 1/1985 Lawlor
4,505,055 A 3/1985 Bergmans
4,506,462 A 3/1985 Cavanagh
4,521,979 A 6/1985 Blaser
4,527,345 A 7/1985 Lopez Lopez
4,542,598 A 9/1985 Misevich et al.
4,546,559 A 10/1985 Dassler
4,557,059 A 12/1985 Misevich et al.
4,559,723 A * 12/1985 Hamy et al. ..... 36/30 R X
4,559,724 A 12/1985 Norton
4,561,195 A 12/1985 Onoda et al.
4,577,417 A 3/1986 Cole
4,578,882 A 4/1986 Talarico, II
4,580,359 A 4/1986 Kurrash et al.
4,624,061 A 11/1986 Wezel et al.
4,624,062 A 11/1986 Autry
4,641,438 A 2/1987 Laird et al.
4,642,917 A 2/1987 Ungar
4,651,445 A 3/1987 Hannibal
4,670,995 A 6/1987 Huang
4,676,010 A 6/1987 Cheskin
4,694,591 A * 9/1987 Banich et al. ..... 36/30 R X
4,697,361 A 10/1987 Ganter et al.
D293,275 S 12/1987 Bua
4,715,133 A 12/1987 Hartjes et al.
4,724,622 A 2/1988 Mills
D294,425 S 3/1988 Le
4,727,660 A 3/1988 Bernhard
4,730,402 A * 3/1988 Norton et al. ..... 36/30 R
4,731,939 A 3/1988 Parracho et al.
4,747,220 A 5/1988 Autry et al.
D296,149 S 6/1988 Diaz
D296,152 S 6/1988 Selbiger
4,748,753 A 6/1988 Ju
4,754,561 A 7/1988 Dufour
4,756,098 A 7/1988 Boggia
4,757,620 A * 7/1988 Tiitola ..... 36/30 R X
4,759,136 A 7/1988 Stewart et al.
4,768,295 A 9/1988 Ito
4,785,557 A 11/1988 Kelley et al.
4,817,304 A 4/1989 Parker et al.
4,827,631 A 5/1989 Thornton
4,833,795 A 5/1989 Diaz
4,837,949 A 6/1989 Dufour
4,854,057 A 8/1989 Misevich et al.
4,858,340 A * 8/1989 Pasternak ..... 36/30 R X
4,866,861 A 9/1989 Noone
4,876,807 A 10/1989 Tittola et al.
4,890,398 A 1/1990 Thomasson
4,906,502 A 3/1990 Rudy
4,922,631 A 5/1990 Anderie
4,934,070 A 6/1990 Mauger
4,934,073 A 6/1990 Robinson
4,947,560 A 8/1990 Fuerst et al.
4,949,476 A 8/1990 Anderie
4,982,737 A 1/1991 Guttmann
4,989,349 A 2/1991 Ellis
D315,634 S 3/1991 Yung-Mao
5,010,662 A 4/1991 Dabuzhsky et al.
5,014,449 A 5/1991 Richard et al.
5,024,007 A 6/1991 DuFour
5,025,573 A 6/1991 Giese et al.
5,052,130 A 10/1991 Barry et al.
5,077,916 A 1/1992 Benteau
5,079,856 A 1/1992 Truelsen
5,092,060 A 3/1992 Frachey et al.
5,131,173 A 7/1992 Anderie

| | | | |
|---|---|---|---|
| 5,224,280 | A | 7/1993 | Preman et al. |
| 5,224,810 | A | 7/1993 | Pitkin |
| 5,237,758 | A | 8/1993 | Zachman |
| 5,317,819 | A | 6/1994 | Ellis |
| 5,543,194 | A | 8/1996 | Rudy |
| 5,544,429 | A | 8/1996 | Ellis |
| 5,909,948 | A | 6/1999 | Ellis, III |
| 6,115,941 | A | 9/2000 | Ellis, III |
| 6,115,945 | A | 9/2000 | Ellis, III |
| 6,163,982 | A | 12/2000 | Ellis, III |

FOREIGN PATENT DOCUMENTS

| | | |
|---|---|---|
| CA | 1 176 458 | 10/1984 |
| DE | B23257 VII/71a | 5/1956 |
| DE | 1 888 119 | 2/1964 |
| DE | 1 287 477 | 1/1969 |
| DE | 1 290 844 | 3/1969 |
| DE | 1 685 260 | 10/1971 |
| DE | 27 06 645 | 8/1978 |
| DE | 27 37 765 | 3/1979 |
| DE | 28 05 426 | 8/1979 |
| DE | 30 24 587 A1 | 1/1982 |
| DE | 32 45 182 | 5/1983 |
| DE | 33 17 462 | 10/1983 |
| DE | 36 29 245 | 3/1988 |
| EP | 0 048 965 | 4/1982 |
| EP | 0 069 083 | 1/1983 |
| EP | 0 083 449 | 7/1983 |
| EP | 0 130 816 | 1/1985 |
| EP | 0 185 781 | 7/1986 |
| EP | 0 206 511 | 12/1986 |
| EP | 0 213 257 | 3/1987 |
| EP | 0 215 974 | 4/1987 |
| EP | 0 238 995 | 9/1987 |
| EP | 0 260 777 | 3/1988 |
| EP | 0 301 331 | 2/1989 |
| EP | 0 329 391 | 8/1989 |
| EP | 0 410 087 | 1/1991 |
| FR | 602.501 | 3/1926 |
| FR | 925.961 | 9/1947 |
| FR | 1.004.472 | 3/1952 |
| FR | 1.323.455 | 2/1963 |
| FR | 2 006 270 | 11/1971 |
| FR | 2 261 721 | 9/1975 |
| FR | 2 511 850 | 3/1983 |
| FR | 2 622 411 | 5/1989 |
| GB | 16143 | 2/1892 |
| GB | 9591 | 11/1913 |
| GB | 764956 | 1/1957 |
| GB | 807305 | 1/1959 |
| GB | 2 023 405 | 1/1980 |
| GB | 2 039 717 | 8/1980 |
| GB | 2 136 670 | 9/1984 |
| JP | 39-15597 | 8/1964 |
| JP | 45-5154 | 3/1970 |
| JP | 50-71132 | 11/1975 |
| JP | 57-139333 | 8/1982 |
| JP | 59-23525 | 7/1984 |
| JP | 61-55810 | 4/1986 |
| JP | 61-167810 | 10/1986 |
| JP | 1-195803 | 8/1989 |
| JP | 3-85102 | 4/1991 |
| JP | 4-279102 | 10/1992 |
| JP | 5-123204 | 5/1993 |
| NZ | 189890 | 9/1981 |
| WO | WO 87/07480 | 12/1987 |
| WO | WO 88/08263 | 11/1988 |
| WO | WO 89/06500 | 7/1989 |
| WO | WO 90/00358 | 1/1990 |
| WO | WO 91/00698 | 1/1991 |
| WO | WO 91/03180 | 3/1991 |
| WO | WO 91/04683 | 4/1991 |
| WO | WO 91/05491 | 5/1991 |
| WO | WO 91/10377 | 7/1991 |
| WO | WO 91/11124 | 8/1991 |
| WO | WO 91/11924 | 8/1991 |
| WO | WO 91/19429 | 12/1991 |
| WO | WO 92/07483 | 5/1992 |
| WO | WO 92/18024 | 10/1992 |
| WO | WO 93/13928 | 7/1993 |
| WO | WO 94/03080 | 2/1994 |
| WO | WO 97/00029 | 1/1997 |
| WO | WO 00/64293 | 11/2000 |

OTHER PUBLICATIONS

Originally filed specification for U.S. patent application No. 08/473,212, filed Jun. 7, 1995.

Originally filed specification for U.S. patent application No. 08/477,640, filed Jun. 7, 1995.

Originally filed specification for U.S. patent application No. 08/033,468, filed Mar. 18, 1993.

Originally filed specification for U.S. patent application No. 08/452,490, filed May 30, 1995, and 08/473,974 filed Jun. 7, 1995.

Originally filed specification for U.S. patent application No. 08/479,776, filed Jun. 7, 1995.

Originally filed specification for U.S. patent application No. 09/908,688, filed Jul. 20, 2001.

Williams, "Walking on Air," *Case Alumnus*, Fall 1989, vol. LXVII, No. 6, pp. 4–8.

Brooks advertisement, *Runner's World*, Jun. 1989, p. 56+3pp.

German destription of adidas badminton shoe (top row, left), pre 1989(?).

Nigg et al., "Influence of Heel Flare and Midesole Construction on Pronation, Supination, and Impact Forces for Heel–Toe Running," *International Journal of Sport Biomechancis*, 1988, vol. 4, No. 3, pp. 205–219.

Nigg et al., "The influence of lateral heel flare of running shoes on pronation and impact forces," *Medicine and Science in Sports and Excercise*, ©1987, vol. 19, No. 3, pp. 294–302.

The Reebok Lineup, Fall 1987, 2 pages.

Cavanagh et al., "Biological Aspects of Modeling Shoe/Foot Interaction During Running," *Sport Shoes and Playing Surfaces: Biomechanical Proper ties*, Champaign, IL, ©1984, pp. 24–25, 32–35, and 46–47.

Blechschmidt, "The Structure of the Calcaneal Padding," *Foot & Ankle*, ©1982, Official Journal of the American Orthopaedic Foot Society, Inc., pp. 260–283.

Cavanagh, *The Running Shoe Book*, Mountain View, CA, ©1980, pp. 176–180.

Ellis, III, *Executive Summary*l, two pages with Figures I–VII attached.

* cited by examiner

SHOE SOLE STRUCTURES

CROSS-REFERENCE TO RELATED APPLICATIONS

This application is a continuation of Ser. No. 08/452,490 filed on May 30, 1995 (Atty. Dkt. ELL-004/CON3), which in turn is a continuation of Ser. No. 08/142,120 filed on Oct. 28, 1993, now abandoned, which is a continuation of Ser. No. 07/830,747 filed on Feb. 7, 1992, now abandoned which is a continuation of Ser. No. 416,478 filed Oct. 3, 1989, now abandoned and application Ser. No. 08/162,962 filed Dec. 8, 1993, now U.S. Pat. No. 5,544,429 which is a continuation of Ser. No. 07/930,469 filed Aug. 20, 1992, now U.S. Pat. No. 5,317,819 issued Jun. 7, 1994 which is a continuation of Ser. No. 07/239,667 filed Sep. 2, 1988, now abandoned and application Ser. No. 07/492,360, filed Mar. 9, 1990, now U.S. Pat. No. 4,989,349 issued Feb. 5, 1991 which is a continuation of Ser. No. 07/219,387, filed Jul. 15, 1988, now abandoned.

BACKGROUND OF THE INVENTION

This invention relates generally to the structure of shoes. More specifically, this invention relates to the structure of running shoes. Still more particularly, this invention relates to variations in the structure of such shoes having a sole contour which follows a theoretically ideal stability plane as a basic concept, but which deviates therefrom outwardly, to provide greater than natural stability. Still more particularly, this invention relates to the use of structures approximating, but increasing beyond, a theoretically ideal stability plane to provide greater than natural stability for an individual whose natural foot and ankle biomechanical functioning having been degraded by a lifetime use of flawed existing shoes.

Existing running shoes are unnecessarily unsafe. They seriously disrupt natural human biomechanics. The resulting unnatural foot and ankle motion leads to what are abnormally high levels of running injuries.

Proof of the natural effect of shoes has come quite unexpectedly from the discovery that, at the extreme end of its normal range of motion, the unshod bare foot is naturally stable, almost unsprainable, while the foot equipped with any shoe, athletic or otherwise, is artificially unstable and abnormally prone to ankle sprains. Consequently, ordinary ankle sprains must be viewed as largely an unnatural phenomena, even though fairly common. Compelling evidence demonstrates that are stability of bare feet is entirely different from the stability of shoe-equipped feet.

The underlying cause of the universal instability of shoes is a critical but correctable design flaw. That hidden flaw, so deeply ingrained in existing shoe designs, is so extraordinarily fundamental that it has remained unnoticed until now. The flaw is revealed by a novel new biomechanical test, one that is unprecedented in its simplicity. The test simulates a lateral ankle sprain while standing stationary. It is easy enough to be duplicated and verified by anyone; it only takes a few minutes and requires no scientific equipment or expertise.

The simplicity of the test belies its surprisingly convincing results. It demonstrates an obvious difference in stability between a bare foot and a running shoe, a difference so unexpectedly huge that it makes an apparently subjective test clearly objective instead. The test proves beyond doubt that all existing shoes are unsafely unstable.

The broader implications of this uniquely unambiguous discovery are potentially far-reaching. The same fundamental flaw in existing shoes that is glaringly exposed by the new test also appears to be the major cause of chronic overuse injuries, which are unusually common in running, as well as other sport injuries. It causes the chronic injuries in the same way it causes ankle sprains; that is, by seriously disrupting natural foot and ankle biomechanics.

The applicant has introduced into the art the concept of a theoretically ideal stability plane as a structural basis for shoe sole designs. That concept as implemented into shoes such as street shoes and athletic shoes is presented in pending U.S. application Ser. Nos. 07/219,387, filed on Jul. 15, 1988; 07/239,667, filed on Sep. 2, 1988; and 07/400,714, filed an Aug. 30, 1989, as well as in PCT Application No. PCT/US89/03076 filed on Jul. 14, 1989. The purpose of the theoretically ideal stability plane as described in these applications was primarily to provide a natural design that allows for natural foot and ankle biomechanics as close as possible to that between the foot and the ground, and to avoid the serious interference with natural foot and ankle biomechanics inherent in existing shoes.

This new invention is a modification of the inventions disclosed and claimed in the earlier applications and develops the application of the concept of the theoretically ideal stability plane to other shoe structures. As such, it presents certain structural ideas which deviate outwardly from the theoretically ideal stability plane to compensate for faulty foot biomechanics caused by the major flaw in existing shoe designs identified in the earlier patent applications.

The shoe sole designs in this application are based on a recognition that lifetime use of existing shoes, the unnatural design of which is innately and seriously flawed, has produced actual structural changes in the human foot and ankle. Existing shoes thereby have altered natural human biomechanics in many, if not most, individuals to an extent that must be compensated for in an enhanced and therapeutic design. The continual repetition of serious interference by existing shoes appears to have produced individual biomechanical changes that may be permanent,so simply removing the cause is not enough. Treating the residual effect must also be undertaken.

Accordingly, it is a general object of this invention to elaborate upon the application of the principle of the theoretically ideal stability plane to other shoe structures.

It is still another object of this invention to provide a shoe having a sole contour which deviates outwardly in a constructive way from the theoretically ideal stability plane.

It is another object of this invention to provide a sole contour having a shape naturally contoured to the shape of a human foot, but having a shoe sole thickness which is increases somewhat beyond the thickness specified by the theoretically ideal stability plane.

It is another object of this invention to provide a naturally contoured shoe sole having a thickness somewhat greater than mandated by the concept of a theoretically ideal stability plane, either through most of the contour of the sole, or at preselected portions of the sole.

It is yet another object of this invention to provide a naturally contoured shoe sole having a thickness which approximates a theoretically ideal stability plane, but which varies toward either a greater thickness throughout the sole or at spaced portions thereof, or toward a similar but lesser thickness.

These and other objects of the invention will become apparent from a detail description of the invention which follows taken with the accompanying drawings.

BRIEF SUMMARY OF THE INVENTION

Directed to achieving the aforementioned objects and to overcoming problems with prior art shoes, a shoe according to the invention comprises a sole having at least a portion thereof following approximately the contour of a theoretically ideal stability plane, preferably applied to a naturally contoured shoe sole approximating the contour of a human foot.

In another aspect, the shoe includes a naturally contoured sole structure exhibiting natural deformation which closely parallels the natural deformation of a foot under the same load, and having a contour which approximates, but increases beyond the theoretically ideal stability plane. When the shoe sole thickness is increased beyond the theoretically ideal stability plane, greater than natural stability results; when thickness is decreased, greater than natural motion results.

In a preferred embodiment, such variations are consistent through all frontal plane cross sections so that there are proportionally equal increases to the theoretically ideal stability plane from the front to back. In alternative embodiments, the thickness may increase, then decrease at respective adjacent locations, or vary in other thickness sequences.

The thickness variations may be symmetrical on both sides, or asymmetrical, particularly since it may be desirable to provide greater stability for the medial side than the lateral side to compensate for common pronation problems. The variation pattern of the right shoe can vary from that of the left shoe. Variation in shoe sole density or bottom sole tread can also provided reduced but similar effects.

These and other features of the invention will become apparent from the detailed description of the invention which follows.

DETAILED DESCRIPTION OF THE PREFERRED EMBODIMENTS

Figure 1:
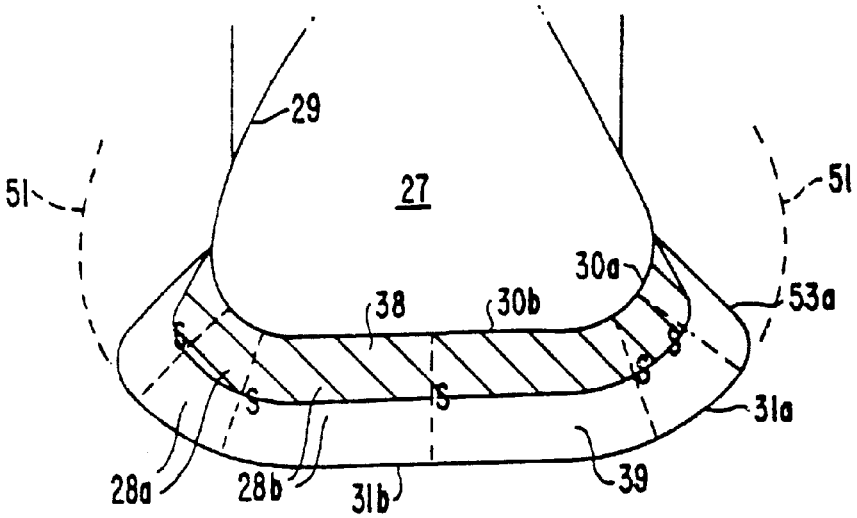
FIG. 1 shows, in frontal plane cross section at the heel portion of a shoe, the applicant's prior invention of a shoe sole with naturally contoured sides based on a theoretically ideal stability plane.
Figure 2:
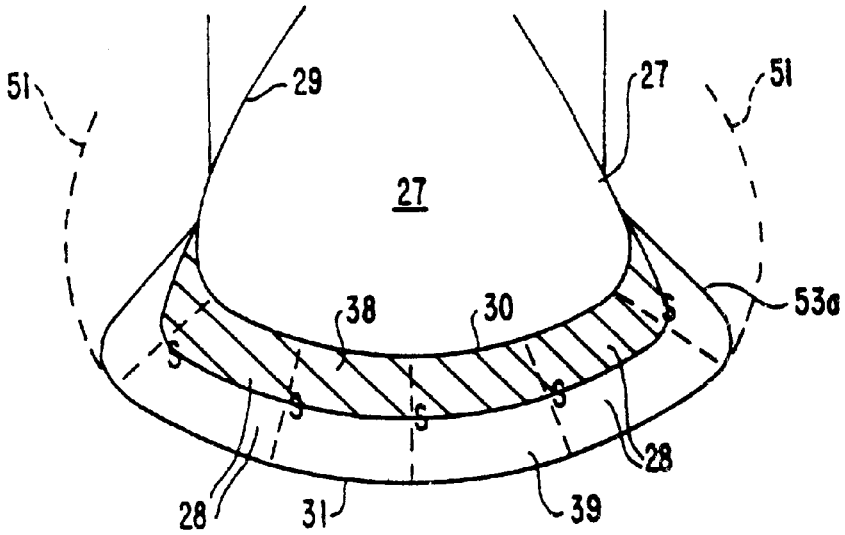
FIG. 2 shows, again in frontal plane cross section, the most general case of the applicant's prior invention, a fully contoured shoe sole that follows the natural contour of the bottom of the foot as well as its sides, also based on the theoretically ideal stability plane.
Figure 3A:
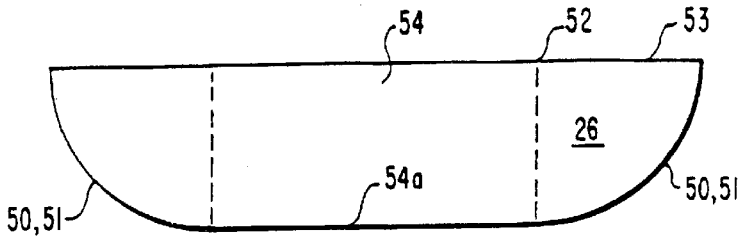
FIG. 3 as seen in FIGS. 3A to 3C in frontal plane cross section at the heel shows the applicant's prior invention for conventional shoes, a quadrant-sided shoe sole, based on a theoretically ideal stability plane.
Figure 3B:
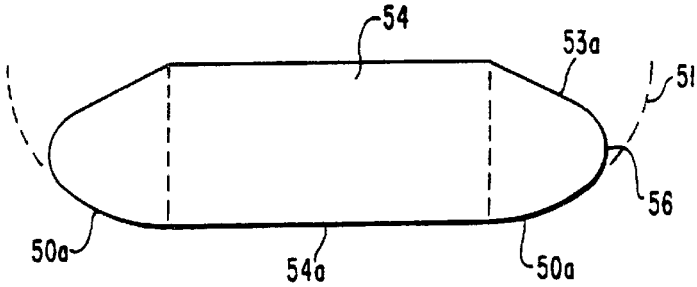
Figure 3C:
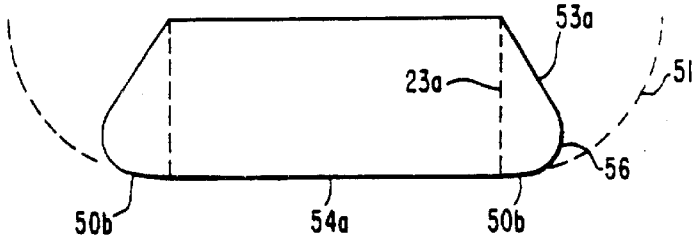
Figure 4:
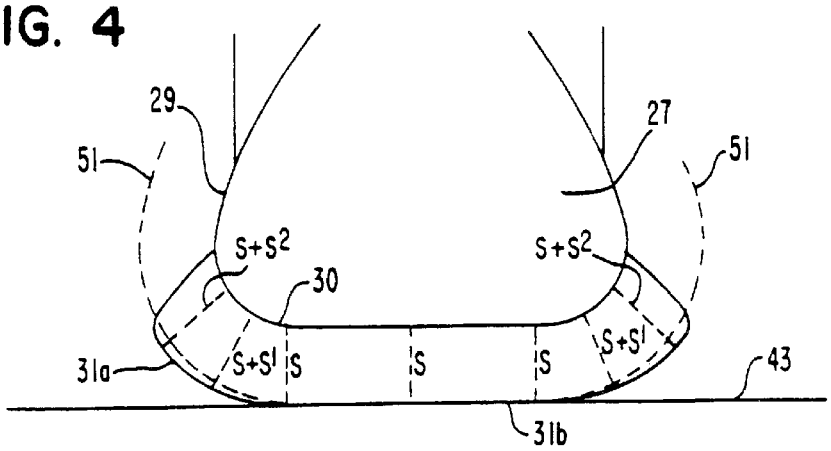
FIG. 4 shows a frontal plane cross section at the heel portion of a shoe with naturally contoured sides like those of FIG. 1, wherein a portion of the shoe sole thickness is increased beyond the theoretically ideal stability plane.
Figure 6:
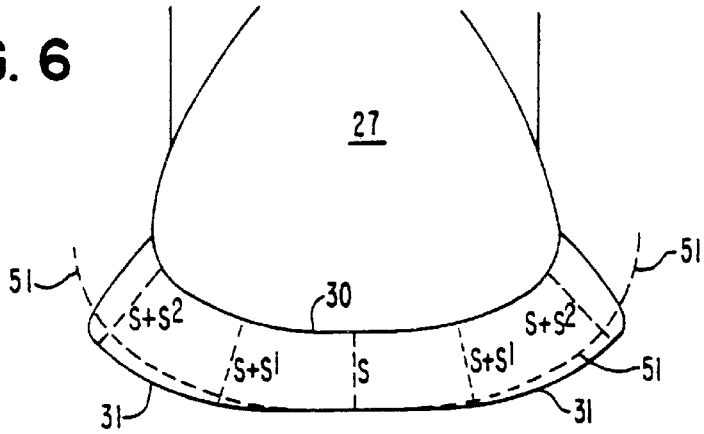

FIGS. 1, 2, and 3 show frontal plane cross sectional views of a shoe sole according to the applicant's prior inventions based on the theoretically ideal stability plane, taken at about the ankle joint to show the heel section of the shoe. FIGS. 4 through 13 show the same view of the applicant's enhancement of that invention. The reference numerals are like those used in the prior pending applications of the applicant mentioned above and which are incorporated by reference for the sake of completeness of disclosure, if necessary. In the figures, a foot 27 is positioned in a naturally contoured shoe having an upper 21 and a sole 28. The sole includes a heel lift or wedge 38 and combined midsole and outersole 39. The shoe sole normally contacts the ground 43 at about the lower central heel portion thereof, as shown in FIG. 4. The concept of the theoretically ideal stability plane, as developed in the prior applications as noted, defines the plane 51 in terms of a locus of points determined by the thickness (s) of the sole. The thickness (s) of the sole at a particular location is measured by the length of a line extending perpendicular to a line tangent to the sole inner surface at the measured location, all as viewed in a frontal plane cross section of the sole. See, for example, FIGS. 1, 2, and 4–7. This thickness (s) may also be referred to as a "radial thickness" of the shoe sole.

FIG. 1 shows, in a rear cross sectional view, the application of the prior invention showing the inner surface of the shoe sole conforming to the natural contour of the foot and the thickness of the shoe sole remaining constant in the front plane, so that the outer surface coincides with the theoretically ideal stability plane.

FIG. 2 shows a fully contoured shoe sole design of the applicant's prior invention that follows the natural contour of all of the foot, the bottom as well as the sides, while retaining a constant shoe sole thickness in the frontal plane.

The fully contoured shoe sole assumes that the remaining slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 2 would deform by flattening to look essentially like FIG. 1. Seen in this light, the naturally contoured side design in FIG. 1 is a more conventional, conservative design that is a special case of the more general fully contoured design in FIG. 2, which is the closest to the natural form of the foot, but the least conventional. The amount of deformation flattening used in the FIG. 1 design, which obviously varies under different loads, it not an essential element of the applicant's invention.

FIGS. 1 and 2 both show in frontal plane cross sections the essential concept underlying this invention, that theoretically ideal stability plane, which is also theoretically ideal for efficient natural motion of all kinds, including running, jogging or walking. FIG. 2 shows the most general case of the invention, the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29.

For the special case shown in FIG. 1, the theoretically ideal stability plane for any particular individual (or size average of individuals) is determined, first, by given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts. Shown in FIG. 1, the first part is a line segment 31*b* of equal length and parallel to line 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described.

It can be stated unequivocally that any shoe sole contour, even of similar contour, that exceeds the theoretically ideal stability plane will restrict natural foot motion, while any less than that plane will degrade naturally stability, in direct proportion to the amount of the deviation. The theoretical ideal was taken to be that which is closest to natural.

FIG. 3 illustrates in frontal plane cross section another variation of the applicant's prior invention that uses stabilizing quadrants 26 at the outer edge of a conventional shoe sole 28*b* illustrated generally at the reference numeral 28. The stabilizing quadrants would be abbreviated in actual embodiments.

FIG. 4 illustrates the applicant's new invention of shoe sole side thickness increasing beyond the theoretically ideal stability plane to increase stability somewhat beyond its natural level. The unavoidable trade-off resulting is that natural motion would be restricted somewhat and the weight of the shoe sole would increase somewhat.

FIG. 4 shows a situation wherein the thickness of the sole at each of the opposed sides is thicker at the portions of the sole 31*a* by a thickness which gradually varies continuously from a thickness (s) through a thickness (s+s1), to a thickness (s+s2). Again, as shown in the figures and noted above, the thickness (s) of the sole at a particular location is measured by the length of a line extending perpendicular to a line tangent to the sole inner surface at the measured location, all as viewed in a front plane cross section of the sole. The thickness (s) may also be referred to as a "radial thickness" of the shoe sole.

These designs recognize that lifetime use of existing shoes, the design of which has an inherent flaw that continually disrupts natural human biomechanics, has produced thereby actual structural changes in a human foot and ankle to an extent that must be compensated for. Specifically, one of the most common of the abnormal effects of the inherent existing flaw is a weakening of the long arch of the foot, increasing pronation. These designs therefore modify the applicant's preceding designs to provide greater than natural stability and should be particularly useful to individuals, generally with low arches, prone to pronate excessively, and could be used only on the medial side. Similarly, individuals with high arches and a tendency to over supinate and lateral ankle sprains would also benefit, and the design could be used only on the lateral side. A shoe for the general population that compensates for both weaknesses in the same shoe would incorporate the enhanced stability of the design compensation on both sides.

The new design in FIG. 4, like FIGS. 1 and 2, allows the shoe sole to deform naturally closely paralleling the natural deformation of the barefoot underload; in addition, shoe sole material must be of such composition as to allow the natural deformation following that of the foot.

The new designs retain the essential novel aspect of the earlier designs; namely, contouring the shape of the shoe sole to the shape of the human foot. The difference is that the shoe sole thickness in the frontal plane is allowed to vary rather than remain uniformly constant. More specifically, FIGS. 4, 5, 6, 7, and 11 show, in frontal plane cross sections at the heel, that the shoe sole thickness can increase beyond the theoretically ideal stability plane 51, in order to provide greater than natural stability. Such variations (and the following variations) can be consistent through all frontal plane cross sections, so that there are proportionately equal increases to the theoretically ideal stability plane 51 from the front of the shoe sole to the back, or that the thickness can vary, preferably continuously, from one frontal plane to the next.

The exact amount of the increase in shoe sole thickness beyond the theoretically ideal stability plane is to be determined empirically. Ideally, right and left shoe soles would be custom designed for each individual based on an biomechanical analysis of the extent of his or her foot and ankle disfunction in order to provide an optimal individual correction. If epidemiological studies indicate general corrective patterns for specific categories of individuals or the population as a whole, then mass-produced corrective shoes with soles incorporating contoured sides exceeding the theoretically ideal stability plane would be possible. It is expected that any such mass-produced corrective shoes for the general population would have thicknesses exceeding the theoretically ideal stability plane by an amount up to 5 or 10 percent, while more specific groups or individuals with more severe disfunction could have an empirically demonstrated need for greater corrective thicknesses on the order of up to 25 percent more than the theoretically ideal stability plane. The optimal contour for the increased thickness may also be determined empirically.

Figure 5:
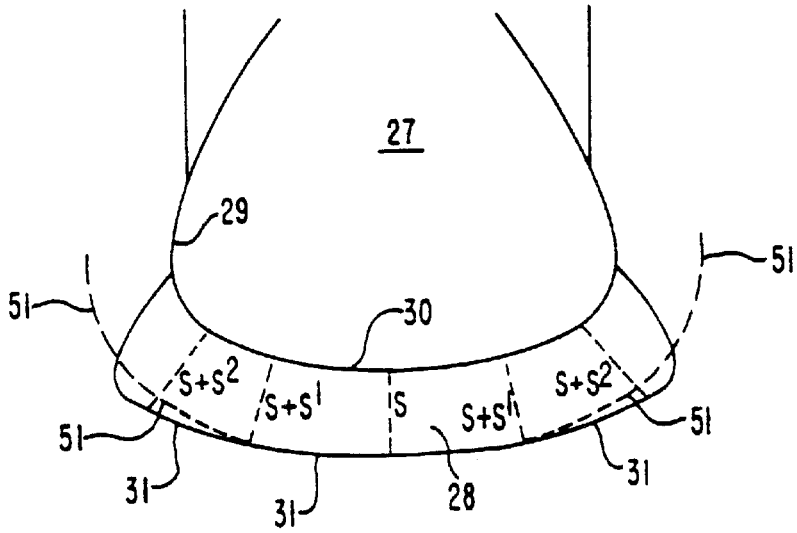
FIG. 5 is a side view similar to FIG. 4, but of a shoe with fully contoured sides wherein the sole thickness increases with increasing distance from the center line of the ground-engaging portion of the sole.

FIG. 5 shows a variation of the enhanced fully contoured design wherein the shoe sole begins to thicken beyond the theoretically ideal stability plane 51 somewhat offset to the sides.

Figure 7:
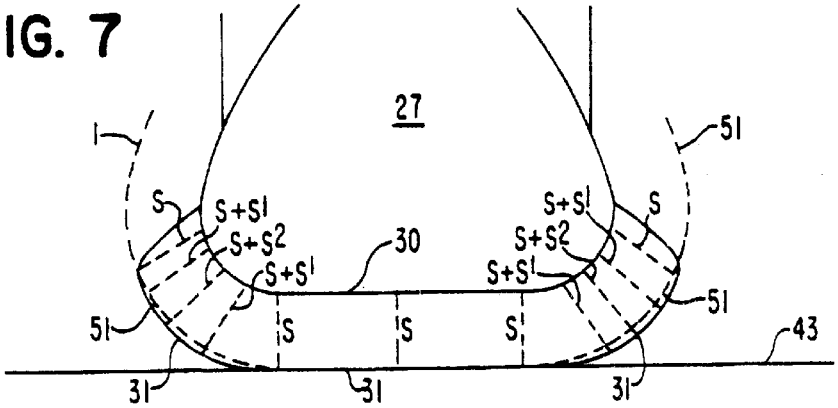
FIG. 7 is a view similar to FIGS. 4 to 6 wherein the sole thicknesses vary in diverse sequences.

FIG. 7 shows that the thickness can also increase and then decrease; other thickness variation sequences are also possible. The variation in side contour thickness in the new invention can be either symmetrical on both sides or asymmetrical, particularly with the medial side providing more stability than the lateral side, although many other asymmetrical variations are possible, and the pattern of the right foot can vary from that of the left foot.

FIGS. 8, 9, 10 and 12 show that similar variations in shoe midsole (other portions of the shoe sole area not shown) density can provide similar but reduced effects to the variations in shoe sole thickness described previously in FIGS. 4 through 7. The major advantage of this approach is that the structural theoretically ideal stability plane is retained, so that naturally optimal stability and efficient motion are retained to the maximum extent possible.

Figure 8:
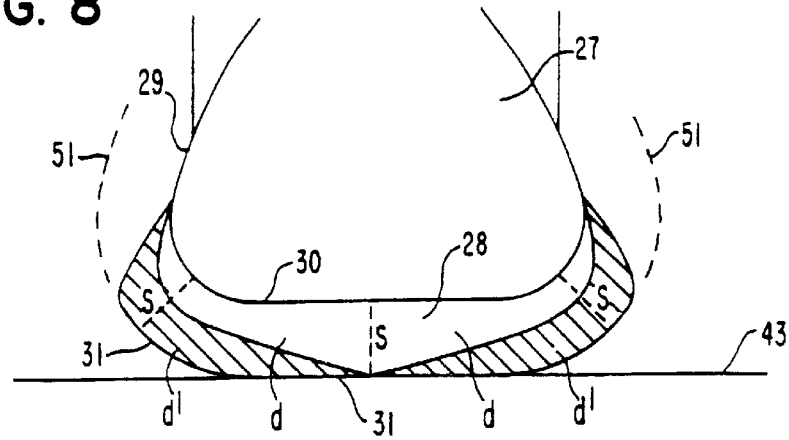
FIG. 8 is a frontal plane cross section showing a density variation in the midsole.
Figure 9:
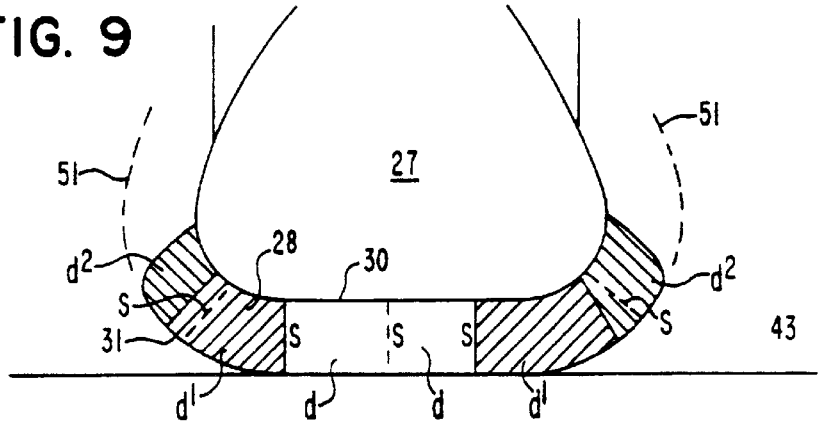
FIG. 9 is a view similar to FIG. 8 wherein the firmest density material is at the outermost edge of the midsole contour.

The forms of dual and tri-density midsoles shown in the figures are extremely common in the current art of running shoes, and any number of densities are theoretically possible, although an angled alternation of just two densities like that shown in FIG. 8 provides continually changing composite density. However, the applicant's prior invention did not prefer multi-densities in the midsole, since only a uniform density provides a neutral shoe sole design that does not interfere with natural foot and ankle biomechanics in the way that multi-density shoe soles do, which is by providing different amounts of support to different parts of the foot; it did not, of course, preclude such multi-density midsoles. In these figures, the density of the sole material designated by the legand (d1) is firmer than (d) while (d2) is the firmest of the three representative densities shown. In FIG. 8, a dual density sole is shown, with (d) having the less firm density.

It should be noted that shoe soles using a combination both of sole thicknesses greater than the theoretically ideal stability plane and of midsole densities variations like those just described are also possible but not shown.

Figure 10:
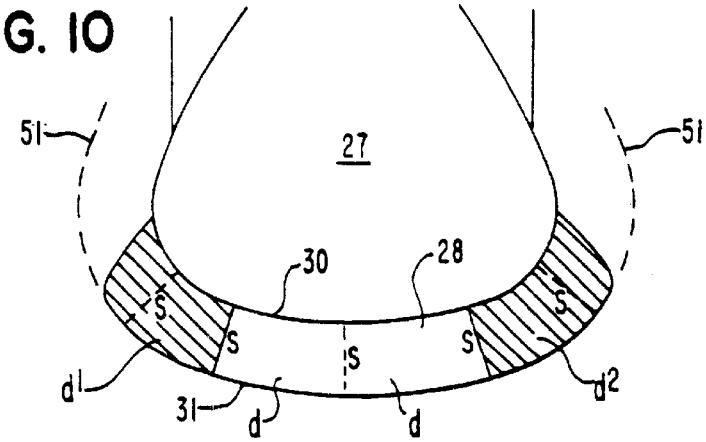
FIG. 10 is a view similar to FIGS. 8 and 9 showing still another density variation, one which is asymetrical.
Figure 11:
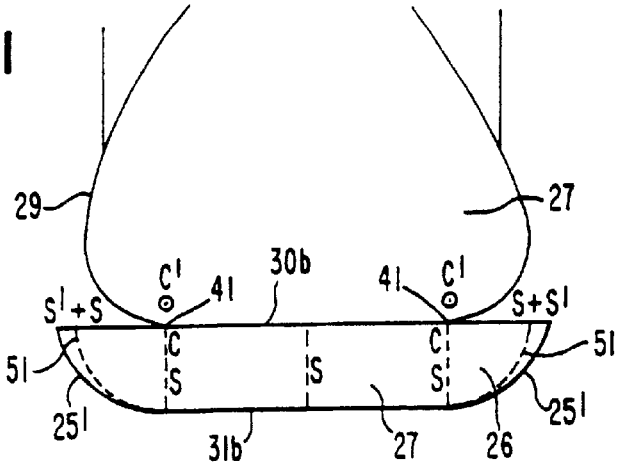
FIG. 11 shows a variation in the thickness of the sole for the quadrant embodiment which is greater than a theoretically ideal stability plane.
Figure 12:
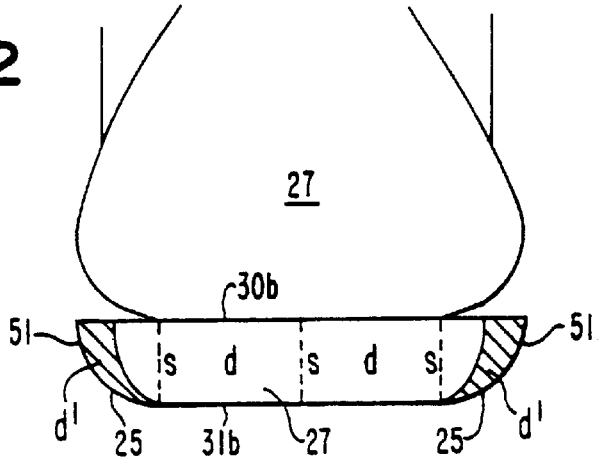
FIG. 12 shows a quadrant embodiment as in FIG. 11 wherein the density of the sole varies.
Figure 13:
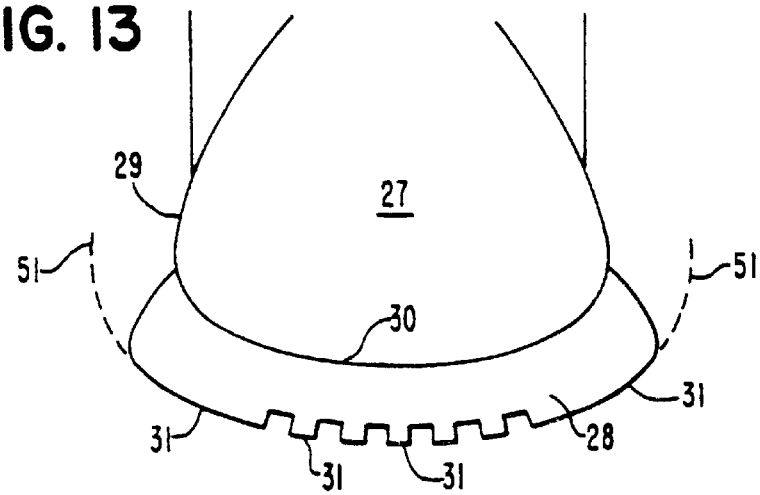
FIG. 13 shows a bottom sole tread design that provides a similar density variation as that in FIG. 10.

FIG. 13 shows a bottom sole tread design that provides about the same overall shoe sole density variation as that provided in FIG. 10 by midsole density variation. The less supporting tread there is under any particular portion of the shoe sole, the less effective overall shoe sole density there is, since the midsole above that portion will deform more easily that if it were fully supported.

FIG. 14 shows embodiments like those in FIG. 4 through 13 but wherein a portion of the shoe sole thickness is decreased to less than the theoretically ideal stability plane. It is anticipated that some individuals with foot and ankle biomechanics that have been degraded by existing shoes may benefit from such embodiments, which would provide less than natural stability but greater freedom of motion, and less shoe sole weight add bulk. In particular, it is anticipated that individuals with overly rigid feet, those with restricted range of motion, and those tending to over-supinate may benefit from the FIG. 14 embodiments. Even more particularly, it is expected that the invention will benefit individuals with significant bilateral foot function asymmetry: namely, a tendency toward pronation on one foot and supination on the other foot. Consequently, it is anticipated that this embodiment would be used only on the shoe sole of the supinating foot, and on the inside portion only, possibly only a portion thereof. It is expected that the range less than the theoretically ideal stability plane would be a maximum of about five to ten percent, though a maximum of up to twenty-five percent may be beneficial to some individuals.

Figure 14A:
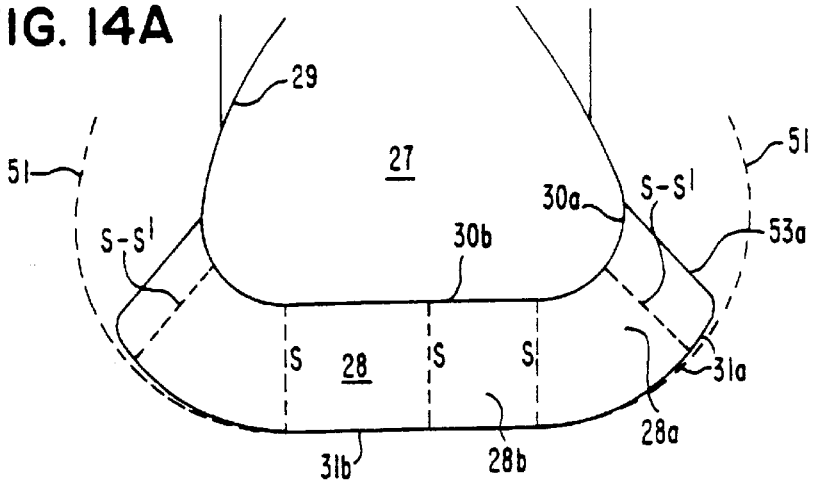
FIG. 14 shows embodiments like FIGS. 1 through 3 but wherein a portion of the shoe sole thickness is decreased to less than the theoretically ideal stability plane.
Figure 14B:
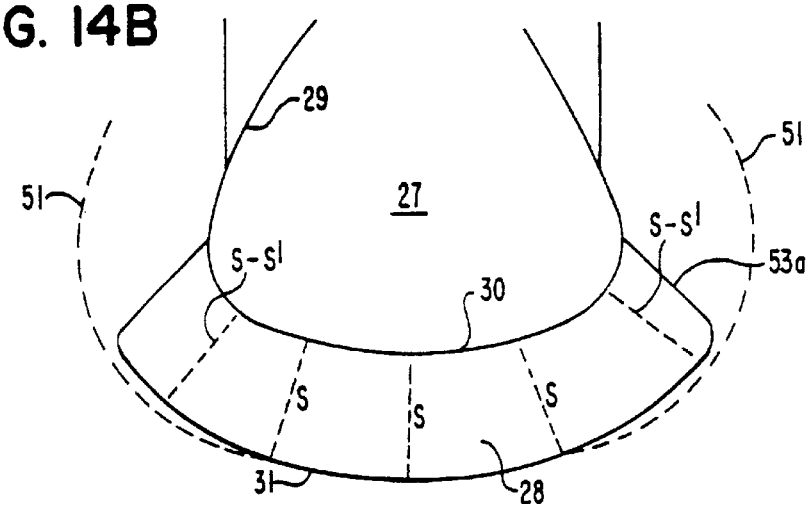
Figure 14C:
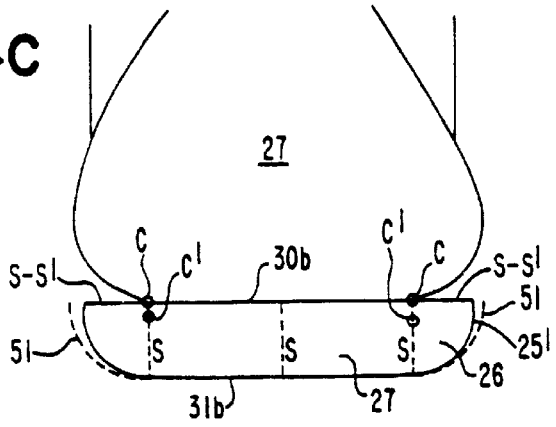

FIG. 14A shows an embodiment like FIGS. 4 and 7, but with naturally contoured sides less than the theoretically ideal stability plane. FIG. 14B shows an embodiment like the fully contoured design in FIGS. 5 and 6, but with a shoe sole thickness decreasing with increasing distance from the center portion of the sole. FIG. 14C shows an embodiment like the quadrant-sided design of FIG. 11, but with the quadrant sides increasingly reduced from the theoretically ideal stability plane.

The lesser-sided design of FIG. 14 would also apply to the FIGS. 8 through 10 and 12 density variation approach and to the FIG. 13 approach using tread design to approximate density variation.

FIGS. 15 A–C show, in cross sections similar to those in pending U.S. application Ser. No. 07/219,387, that with the quadrant-sided design of FIGS. 3, 11, 12 and 14C that it is possible to have shoe sole sides that are both greater and lesser than the theoretically ideal stability plane in the same shoe. The radius of an intermediate shoe sole thickness, taken at ($S^2$) at the base of the fifth metatarsal in FIG. 15B, is maintained constant throughout the quadrant sides of the shoe sole, including both the heel, FIG. 15C, and the forefoot, FIG. 15A, so that the side thickness is less than the theoretically ideal stability plane at the heel and more at the forefoot. Though possible, this is not a preferred approach.

Figure 15A:
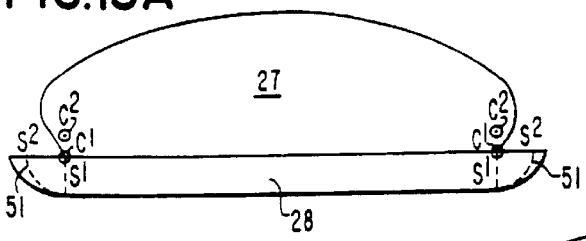
FIG. 15 show embodiments with sides both greater and lesser than the theoretically ideal stability plane.
Figure 15D:
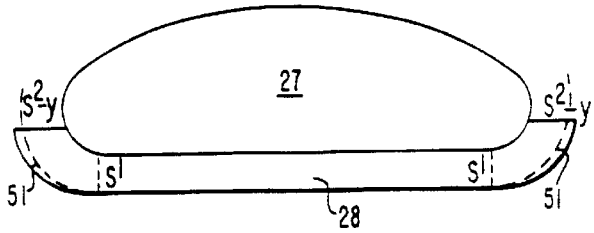
Figure 15B:
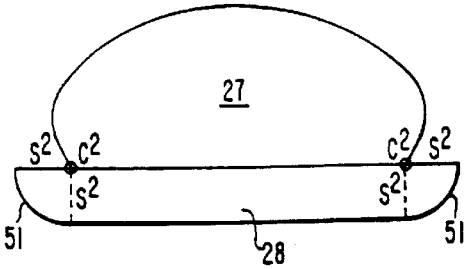
Figure 15E:
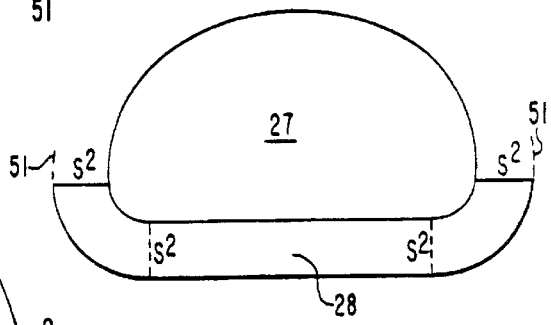
Figure 15C:
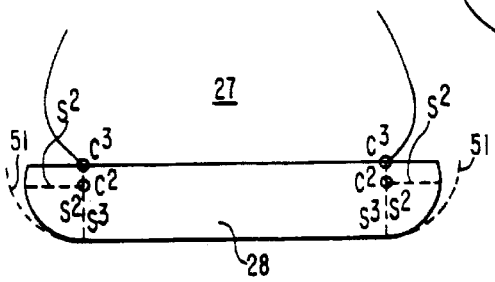
Figure 15F:
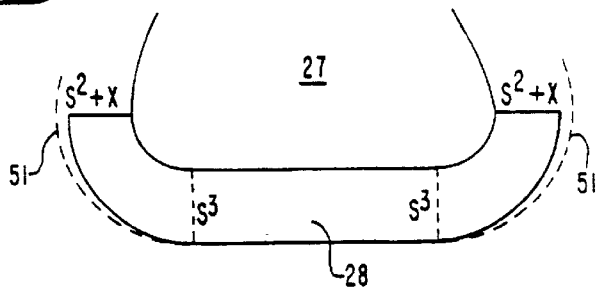

The same approach can be applied to the naturally contoured sides or fully contoured designs described in FIGS. 1, 2, 4 through 10 and 13, but it is also not preferred. In addition, is shown in FIGS. 15 D–F, in cross sections similar to those in pending U.S. application Ser. No. 07/239,667, it is possible to have shoe sole sides that are both greater and lesser than the theoretically ideal stability plane in the same shoe, like FIGS. 15A–C, but wherein the side thickness (or radius) is neither constant like FIGS. 15A–C or varying directly with shoe sole thickness, like in the applicant's pending applications, but instead varying quite indirectly with shoe sole thickness. As shown in FIGS. 15D–F, the shoe sole side thickness varies from somewhat less than shoe sole thickness at the heel to somewhat more at the forefoot. This approach, though possible, is again not preferred, and can be applied to the quadrant sided design, but is not preferred there either.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. An athletic shoe sole for a shoe, comprising:

a shoe outer sole and a shoe midsole;

a sole heel area underneath a heel of an intended wearer's foot, a midsole inner surface for supporting a sole of said intended wearer's foot, and a midsole outer surface;

a midsole central part of the athletic shoe sole located between a midsole medial side portion and a midsole lateral side portion, as viewed in a shoe sole front plane cross-section in the heel area during an unloaded, upright shoe condition;

the midsole lateral side portion formed by that part of the midsole located lateral of a straight vertical line extending through a sidemost extent of the midsole inner surface of a lateral side of the shoe, as viewed in the heel area frontal plane cross-section during an unloaded, upright shoe condition;

the midsole medial side portion formed by that part of the midsole located medial of a straight vertical line extending through a sidemost extent of the midsole inner surface of a medial side of the shoe, as viewed in the heel area frontal plane cross-section during an unloaded, upright shoe condition;

said midsole outer surface of said midsole central part comprising a concavely rounded portion, the concavity existing with respect to an inner section of the midsole located directly adjacent to the concavely rounded portion of the midsole outer surface, all as viewed in the heel area frontal plane cross-section during an unloaded, upright shoe condition;

said midsole inner surface of said midsole central part comprising a convexly rounded portion at least through a midpoint of the midsole inner surface of said midsole central part, the convexity existing with respect to a section of the midsole directly adjacent to the convexly rounded portion of the midsole inner surface, all as viewed in the heel area frontal plane cross-section during an unloaded, upright shoe condition;

the midsole of at least one of the sole medial side portion and sole lateral side portion extending to above a lowest point of the midsole inner surface, as viewed in the heel area frontal plane cross-section during an unloaded, upright shoe condition;

a radial thickness of at least one of the lateral and medial side portions decreases gradually and continuously from above a sidemost extent of at least one of the lateral and medial side portions to an uppermost point of said at least one of the lateral and medial side portions, as viewed in the heel area frontal plane cross-section during an unloaded, upright shoe condition; and said shoe midsole comprises midsole material of varying firmness.

2. The shoe sole as set forth in claim 1, wherein said midsole central part comprises a section having at least two material layers, each layer composed of a midsole material of different firmness, as viewed in the heel area frontal plane cross-section during an unloaded, upright shoe condition.

3. The shoe sole as set forth in claim 1, wherein a midsole firmness of the midsole medial side portion is different from a midsole firmness of the midsole lateral side portion, as viewed in the heel area frontal plane cross-section during an unloaded, upright shoe condition.

4. The shoe sole as set forth in claim 1, wherein the midsole central part has a varying radial thickness, as viewed in the heel area frontal plane cross-section during an unloaded, upright shoe condition.

5. The shoe sole as set forth in claim 1, wherein the concavely rounded portion of the midsole outer surface extends through a lowermost portion of the midsole central part, as viewed in the heel area frontal plane cross-section during an unloaded, upright shoe condition.

6. The shoe sole according to claim 1, wherein the concavely rounded portion of the midsole outer surface extends through a midpoint of the midsole central part, as viewed in the heel area frontal plane cross-section during an unloaded, upright shoe condition.

7. The shoe sole according to claim 1, wherein the midsole includes three different midsole materials, each with a different firmness.

8. The shoe sole according to claim 1, wherein the midsole extends into both the lateral and medial side portions to above a lowest point of the midsole inner surface, as viewed in the heel area frontal plane cross-section during an unloaded, upright shoe condition.

9. The shoe sole according to claim 1, wherein the midsole outer surface comprises concavely rounded portions located at both the midsole lateral side portion and the midsole medial side portion, the concavity existing with respect to an inner section of the shoe midsole located directly adjacent to the concavely rounded portion of the midsole outer surface, all as viewed in the heel area frontal plane cross-section during an unloaded upright shoe condition.

10. The shoe sole as set forth in claim 1, wherein the radial thickness of both of the midsole lateral and medial side portions decreases gradually and continuously from above a sidemost extent of at least one of the lateral and medial side portions to an uppermost point of both of the lateral and medial side portions, as viewed in the heel area frontal plane cross-section during an unloaded, upright shoe condition.

11. The shoe sole as set forth in claim 1, wherein the concavely rounded portion of the midsole outer surface extends from the midsole central part into one of the midsole lateral and medial side portions, as viewed in the heel area frontal plane cross-section during an unloaded, upright shoe condition.

12. The shoe sole as set forth in claim 11, wherein the concavely rounded portion of the midsole outer surface extends from the midsole central part into both of the midsole lateral and medial side portions, as viewed in the heel area frontal plane cross-section during an unloaded, upright shoe condition.

13. The shoe sole as set forth in claim 1, wherein the concavely rounded portion of the midsole outer surface extends from the midsole central part continuously through a sidemost extent of one of the midsole lateral and medial side portions, as viewed in the heel area frontal plane cross-section during an unloaded, upright shoe condition.

14. The shoe sole as set forth in claim 13, wherein the concavely rounded portion of the midsole outer surface extends from the midsole central part continuously through sidemost extents of both of the midsole lateral and medial side portions, as viewed in the heel area frontal plane cross-section during an unloaded, upright shoe condition.

15. The shoe sole according to claim 1, wherein the concavely rounded portion of the midsole outer surface extends from the midsole central part to above the lowest point on the midsole inner surface on one of the midsole lateral and medial side portions, as viewed in the heel area frontal plane cross-section during an unloaded, upright shoe condition.

16. The shoe sole as set forth in claim 15, wherein the concavely rounded portion of the midsole outer surface extends from the midsole central part to above the lowest point on the midsole inner surface of both of the midsole lateral and medial side portions, as viewed in the heel area frontal plane cross-section during an unloaded, upright shoe condition.

17. The shoe sole according to claim 1, wherein the midsole comprises two different material, one material having a greater radial thickness in one of the lateral and medial side portions than a radial thickness in the midsole central part, as viewed in the heel area frontal plane cross-section during an unloaded, upright shoe condition.

18. The shoe sole according to claim 17, wherein one of the two different midsole materials has a greater radial thickness in the midsole central part than a radial thickness in one of the lateral and medial side portions, as viewed in the heel area frontal plane cross-section during an unloaded, upright shoe condition.

19. The shoe sole according to claim 1, wherein the concavely rounded portion of the midsole central part of the midsole outer surface extends to one of said straight vertical lines, as viewed in the heel area frontal plane cross-section during an unloaded, upright shoe condition; and the convexly rounded portion of the midsole central part of the midsole inner surface extends to one of said straight vertical lines, as viewed in the heel area frontal plane cross-section during an unloaded, upright shoe condition.

20. The shoe sole according to claim 19, comprising a concavely rounded portion of the midsole central part of the midsole outer surface extending to the other of said straight vertical lines, as viewed in the heel area frontal plane cross-section during an unloaded, upright shoe condition; and a convexly rounded portion of the midsole central part of the midsole inner surface extending to the other of said straight vertical lines, as viewed in the heel area frontal plane cross-section during an unloaded, upright shoe condition.

* * * * *